US006943679B2

(12) United States Patent
Sebanc et al.

(10) Patent No.: US 6,943,679 B2
(45) **Date of Patent: *Sep. 13, 2005**

(54) PROGRAMMABLE UNIVERSAL LOCATING SYSTEM

(75) Inventors: John Sebanc, P.O. Box 3039, 665 Martis Peak Rd., Incline Village, NV (US) 89450; Robert Chamberlin, Jamesville, NY (US)

(73) Assignee: John Sebanc, Incline Village, NV (US)

( * ) Notice: Subject to any disclaimer, the term of this patent is extended or adjusted under 35 U.S.C. 154(b) by 135 days.

This patent is subject to a terminal disclaimer.

(21) Appl. No.: 10/255,142

(22) Filed: Sep. 24, 2002

(65) Prior Publication Data

US 2003/0076225 A1 Apr. 24, 2003

Related U.S. Application Data

(63) Continuation-in-part of application No. 09/963,843, filed on Sep. 25, 2001, now Pat. No. 6,535,120.

(51) Int. Cl.[7] ..... G08B 26/00

(52) U.S. Cl. ..... 340/505; 340/504; 340/539.11; 340/539.13; 340/539.14; 340/539.15; 340/539.23

(58) Field of Search ..... 340/505, 502, 340/504, 539.1, 539.11, 539.13, 539.14, 539.15, 539.23, 539.32

(56) References Cited

U.S. PATENT DOCUMENTS

| | | | | |
|---|---|---|---|---|
| 4,476,469 | A | 10/1984 | Lander | 340/825.49 |
| 5,598,143 | A | 1/1997 | Wentz | 340/539 |
| 5,638,050 | A | 6/1997 | Sacca et al. | 340/571 |
| 5,883,576 | A | 3/1999 | De La Huerga | 340/573.1 |
| 5,939,981 | A | 8/1999 | Renney | 340/539 |
| 6,346,886 | B1 | 2/2002 | De La Huerga | 340/573.1 |
| 6,535,120 | B1 * | 3/2003 | Sebanc et al. | 340/505 |
| 6,563,427 | B2 * | 5/2003 | Bero et al. | 340/573.1 |

* cited by examiner

*Primary Examiner*—Daryl C Pope
(74) *Attorney, Agent, or Firm*—Sawyer Law Group LLP

(57) ABSTRACT

A locating system comprising a control unit, a first integrated circuit, a first actuator and a transceiver. The control unit is configured with a program mode and a locate mode. The first actuator and the transceiver are coupled to the first integrated circuit and configured such that when the control unit is in program mode and the first actuator is activated, the control unit transmits a first signal indicating that the control unit is in program mode and identifies the first actuator.

22 Claims, 5 Drawing Sheets

PROGRAMMABLE UNIVERSAL LOCATING SYSTEM

CROSS-REFERENCE TO RELATED APPLICATIONS

This application is a continuation-in-part of patent application Ser. No. 09/963,843, filed Sep. 25, 2001 now U.S. Pat. No. 6,535,120.

BACKGROUND

1. Field of the Invention

The present invention relates to the field of detection and location devices and methodologies employing such devices, in particular, for those systems and devices which are used to detect and locate an object or objects, particularly remotely located objects whose location is unknown and sought by the user of the invention.

2. Description of the Related Art

In today's world, with the individual's increasing accumulation of possessions, and the progress of science and commerce constantly creating new consumer goods, it is increasingly difficult for the individual to keep track of or manage his or her possessions. The continued reduction in size of many. of consumer goods containing electrical circuitry makes it easier for the individual to misplace these possessions, with a corresponding increase in difficulty in finding said misplaced possessions. Once, the haven of the lost only belonged to misplaced or mislaid glasses, keys, wallets, gloves, or other small personal items, but now the gates have opened to encompass a multitude of sophisticated electronic devices of reduced size such as portable phones, cellular phones, hand-held computers, personal calendar/diaries, remote controls for automobiles, entertainment devices and their associated remote controls, and the like. Today's individual places great reliance on his or her electronic goods, and a temporary or permanent loss of these goods can cause great impairment to that individual and his or her ability to effectively function in today's society.

There is a need for a means by which an individual can find such misplaced or waylaid items quickly and efficiently. Much of the prior art has focused on transponder/receiver technology in which a hand-held device, large enough so that it cannot be easily lost in the first place, is activated by the individual looking for the undetectable item. Upon activation, the hand-held device would emit a signal that would be detected by a receiver attached to or incorporated into the said misplaced item prior to becoming misplaced. Upon receipt of said signal, the receiver would activate its own signal generator, such as a light or sound emitter, to alert and guide the operator to the lost device's location.

The prior art location apparatus would use ultrasound, infrared, radio frequency and the like for transmission/reception as a means to provide communication between transmitter and the receiver. The various types of circuitry employed therein are well known to those versed in the art.

The U.S. Pat. No. 5,939,981 issued to Renny, U.S. Pat. No. 4,476,469 issued to Lander and U.S. Pat. No. 5,638,050 issued to Sacaa address the use of a wireless communication system comprised of a sending unit and a responding unit wherein a button on the sending unit causes the transmission of a fixed code that will be responded to by a particular responding unit.

What has not been adequately addressed by the prior art are those systems, means and apparati which would enhance the commercial viability of the location art. The issue that needs to be addressed is to allow full commercial realization of the genre of the location art as a whole, not the specific means of location. What is needed is the universal capability of allowing a locator system to have a programmable/re-programmable ability to reset a communication link between a control unit and a response unit that is connected to or made a part of the item sought to be located. This ability to program/re-program would allow an item with a response unit to be easily integrated with one or more control units. This would also allow ease of resale since the new owner could easily reprogram the response device/resold 20 item containing a response device to respond appropriately to the new owner's own central control device.

This universal programmable/re-programmable aspect of such location systems and methods would greatly enhance the probability that manufacturers of consumer devices would utilize the invention knowing that their products would not have a single fixed response communication link, but could easily be programmed and reprogrammed indefinitely to fit that individual consumers' location protocol. Thus, the consumer could buy a multitude of the same product or a multitude of different products, without losing the ability to find any of them when they were lost.

SUMMARY OF THE INVENTION

This invention is a universally programmable/re-programmable locating system and method, whereby the invention has a central control unit that can interact singularly or in combination with a multitude of response devices. Each response unit, either built into or otherwise associated with a searchable item, has the capability of having its communications linked to a central control unit that is easily programmed/reprogrammed. In this manner, an individual response unit can be changeably assigned to a specific actuator of a specific central control unit. This aspect also inversely allows the assignment of a response device to a specific actuator button located on a multitude of central control units.

This aspect of the invention further allows a response unit, either sold as a separate item or incorporated as part of a consumer good, to be easily assigned by the consumer to a specific setting on the individual consumer's specific central control unit which may or may not be sold in conjunction with that particular response unit or that consumer good. At the same time, a response unit could be sold with a central control unit, both of which could be coordinated with other response units and central control units obtained at different times.

The invention allows the user to program the communication relationship between the central control unit and the response unit and allows a response unit to be assigned to a plurality of central control units. The invention enhances the commercial viability of the location art by permitting the response units built into one particular type of commercial goods to have the ability to be programmed in several different communication relations with a single central unit allowing multiple purchases by a single consumer without losing the locating ability of any one specific good.

The invention allows a user to purchase a device containing the response unit, that device becoming a subcomponent of another device, thus allowing the other device to acquire the location/detection capability of the subcomponent.

BRIEF DESCRIPTION OF THE DRAWINGS

The novel features that are considered characteristic of the invention are set forth with particularity in the appended claims. The invention itself, however, both as to its structure and its operation, together with the additional object and advantages thereof, will best be understood from the following description of the preferred embodiment of the present invention when read in conjunction with the accompanying drawings wherein:

DETAILED DESCRIPTION OF THE PREFERRED EMBODIMENTS

The present invention, programmable universal locating system and method, generally denoted by numeral 1, is comprised of two apparati, the central control unit generally denoted by numeral 10, and the response unit generally denoted by numeral 40.

Figure 1:
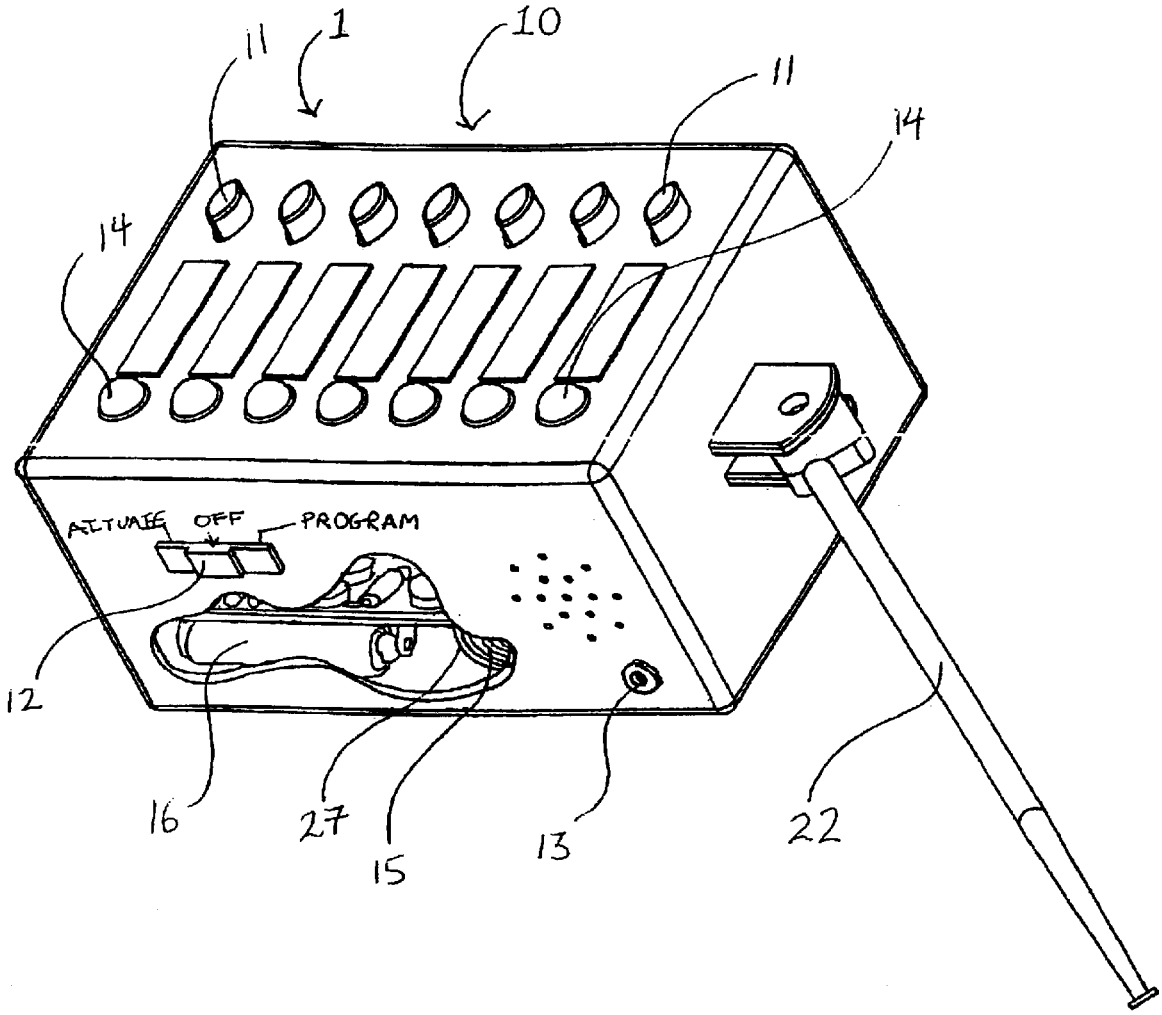
FIG. 1 depicts a partial cut-away perspective view of the central control unit.

As shown in FIG. 1, the preferred embodiment of the central control unit 10 would be a hand-held unit with a surface featuring a plurality of actuator switches 11. The surface would also feature a light emitting source generally referenced as # 14, such as LEDs (Light Emitting Diode) or the like, for indicating the relative distance between the central control unit and a remotely placed response unit. In another embodiment of the central control unit, in lieu of or in addition to the light-emitting source 14, a sound-emitting source, generally referenced by numeral 15, such as a piezo horn, and its operating circuitry, could be used as well. The sound emitting device 15 could be heard by the operator through a cluster of apertures that are placed on the unit.

The surface of the unit would further support a mode selector switch 12 as well as an electrical connection jack 13 for reversibly connecting an external power supply or a external recharger to the internal power supply 16 of the central control unit 10.

The unit would encompass electronic circuitry which is connected to the power source 16, the plurality of actuator switches 11, the mode selector switch 12, the electrical connection jack 13, and the light emitting source 14 or sound emitting device 15.

In another embodiment of the invention 1, the central control unit 10 can also be embodied as an integral part of another good. For example, the circuitry of the central control unit 10 could be incorporated into circuitry of a power source charging unit that is used to charge the internal power source of other goods. The power source charging unit would have the external devices of the central control unit circuitry (e.g., the plurality of actuator switches, mode selection switch, etc). In this manner, the charging unit would have all the primary capabilities of the central control unit, while the goods, which the charging unit is used for, could have the circuitry of the response unit 40. In this other embodiment, the charging unit, such as a battery charger for cell phones, would allow the operator to locate the lost or misplaced goods, such as cell phones that are recharged by a battery charger.

The appearance and construction of the central control unit 10, either as a stand-alone device or as a feature that is incorporated in other goods, can vary widely since the ability to construct the device with a wide variety of "off-the-shelf" componentry is well known to those versed in the art.

Figure 2:
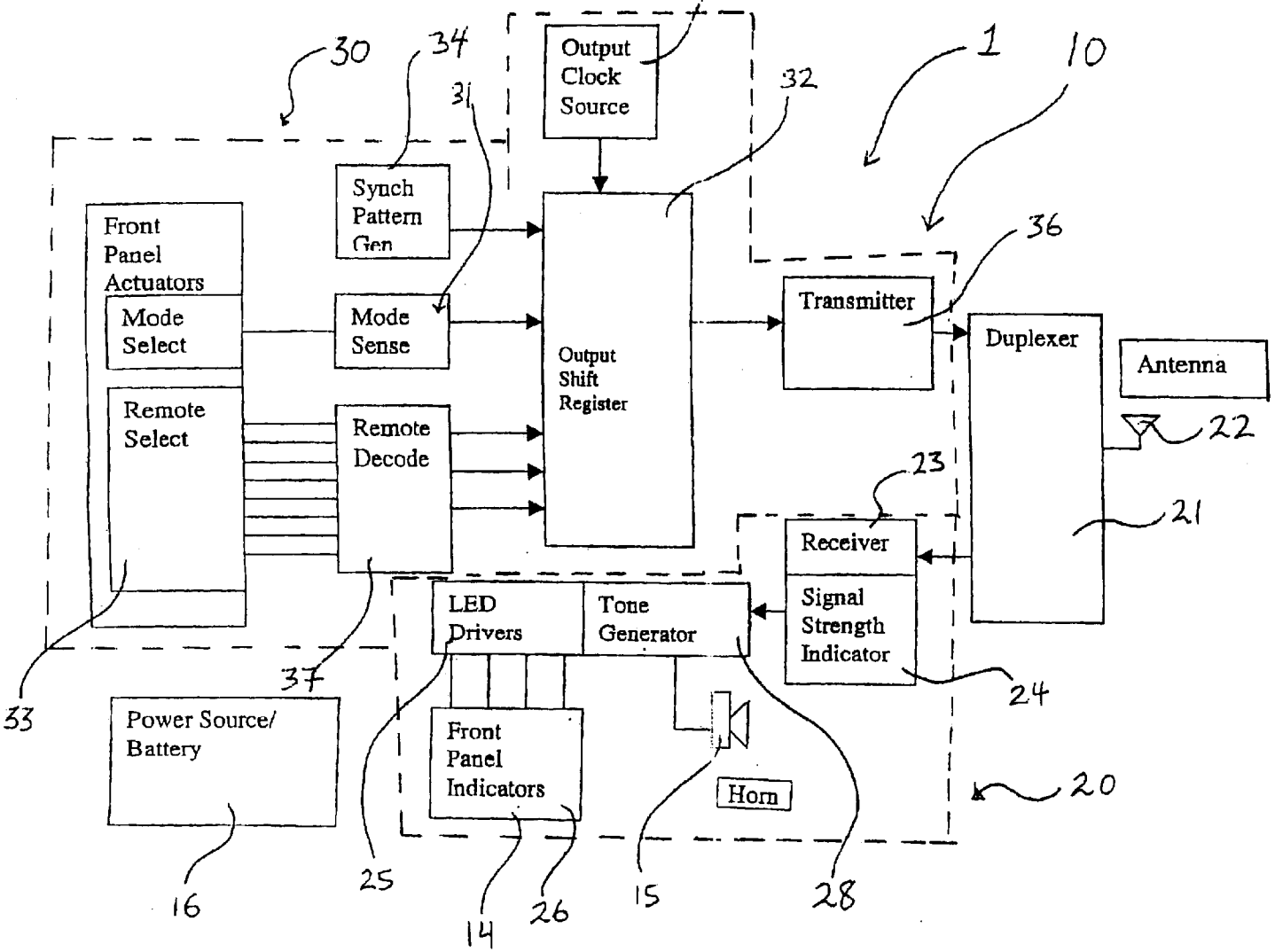
FIG. 2 depicts a block diagram of the elements of the central control unit.

As shown in FIG. 2, the block diagram of the central control unit 10, there are two basic subsystems to the central control unit 10. The first subsystem, the proximity detection unit, is generally referenced by numeral 20. The second subsystem, the universal programming system, is generally denoted by numeral 30.

The proximity detection unit 20 is comprised of a duplexer 21, a receiver 23, a signal strength indicator 24, and a light emitting 14 or sound-emitting 15 source. The duplexer 21, receives and transmits Radio Frequency ("R/F") signals ("radio waves") through its antenna 22. The duplexer 21, in filtering all the R/F signals that its antenna 22 receives, will only allow those R/F emissions which are of a certain frequency or within a certain frequency range to pass through to the receiver 23, i.e. transmissions from the remote unit.

Once the R/F signal is sent to the receiver 23 by the duplexer 21, the receiver 23 transforms the R/F signal into an electrical signal. This electrical signal is passed to the signal strength indicator 24, which reads strength and intensity of the electrical signal sent to it. Based on the strength of the transformed R/F signal, the signal strength indicator 24 sends an electronic signal to the LED drivers 25 whose circuitry powers up the light-emitting source 14 in the preferred embodiment (LEDs) 26. The LED drivers 25, in accordance with the intensity of the electrical signal received from the signal strength indicator 24, cause the LEDs 26 to give off a visual signal corresponding in intensity to the strength of the originally received R/F signal, either through brightness, or if the LED driver 25 incorporated a strobe circuit, through altering the frequency of flashing of the LEDs to indicate to the operator the relative proximity of the central control unit 10 to the response unit 40.

In an other embodiment, the signal strength indicator could also send an electrical signal to a tone generator 28 that would activate an electrical horn 27 or other sound emission device to give off an audible signal, that would also correspond in intensity to the strength of the received R/F signal so as to indicate to the operator the relative proximity of the central control unit 10 to the response unit 40.

The second subsystem, the universal programming system 30, which provides for activation of the programming through actuator switches 11, has a mode selector switch 12 that sets the central control unit 10 for either actuating or programming a selected response unit 40.

The mode selector switch 12 is connected to a mode sense unit 31, which activates the output shift register 32 for operation into programming or activator modes. When the desired mode is set by the mode sense unit 31 for synchronizing the communication link of at least one actuator switch within the plurality of actuator switches 11, also identified as a remote select 33 of the central control unit 10, to at least one response unit 40, the mode sense unit 31 coordinates the circuitry for the output shift register 32, the synchronize pattern generator 34, the output clock source 35 and the transmitter 36, for the accomplishment of that purpose. The activation of a selected actuator sends forth an electrical signal to the remote decoder 37 which translates the signal into binary code for transmission to the output shift register 32. The output shift register 32 assembles the signals from the synch pattern generator 34, the mode sense unit 31 and the remote decoder 37 into a serial bits stream (SBS) signal.

This SBS signal has three distinct fields containing bit information: synchronize, mode and identification. The synchronized field containing data from the synchronize pattern generator 34 is used to allow the response unit 40 upon reception to align its data collection circuit with an incoming SBS R/F signal from the central control unit 10. The mode field contains data bits from the mode sense unit that establish with the response unit 40 the desired mode of operation. The identification field contains the bit pattern generated from the electrical signal from the remote decoder 37 that is specific to a particular actuator.

The output shift register 32 also incorporates a square wave signal made by the output clock source 35 which is used to time the transmission of the assembled signal. The square wave is what allows the coordination between the central control unit 10 and response unit 40. In this manner, R/F signal frequencies, which are limited in their ease of use and capacity, are not used to set the coordination between selected actuator switch and the chosen response units 40. Once the signal is fully assembled, the output shift register 32 sends the SBS electric signal to the transmitter 36 which transforms the electrical SBS signal into a SBS R/F signal. This SBS R/F signal is send to the duplexer 21, which blocks the SBS R/F signal from being received by the proximity detection subsystem 20 and emits the SBS R/F through the antenna 22. In the program mode, the emitted R/F SBS signal is a low level signal so as to only program/re-program that response unit 40 which is in close proximity (e.g. adjacent to) to the operator activated central control unit 10 during the operation of the invention in the programming mode.

After at least one response unit 40 has been programmed/reprogrammed to be activated by at least one actuator switch of at least one central control unit 10, the mode selector switch 12 can then be set for actuator mode. In this mode, the mode sensor 31 coordinates the synchronize pattern generator 34, the output clock source 35 and the output shift register 32. The activation of the selected actuator switch will cause the remote decoder 37 to emit a signal to the output shift register 32. The output shift register 32 will then assemble an SBS signal bearing bit information from the synchronize pattern generator 34, the mode sense unit 31 and the remote decoder 37. The SBS signal fields contain information similar to the programming signal, except the information in the mode field contains activation, not programming code, for the response unit 40 that was previously coordinated with the activated actuator switch.

The output shift register 32 then sends the electrical SBS signal through the transmitter 36, duplexer 21, and antenna 22 which converts the electrical signal into an R/F transmission. Once the R/F signal is picked up by the remotely located or lost coordinated response unit 40, the response unit 40 is activated to send a R/F signal back to the central control unit 10 which translates that signal based on its received strength into an audible and/or visible signal which is readily understood by the operator as being a general indication of the proximate distance between the central control unit 10 and the response unit 40.

Figure 3:
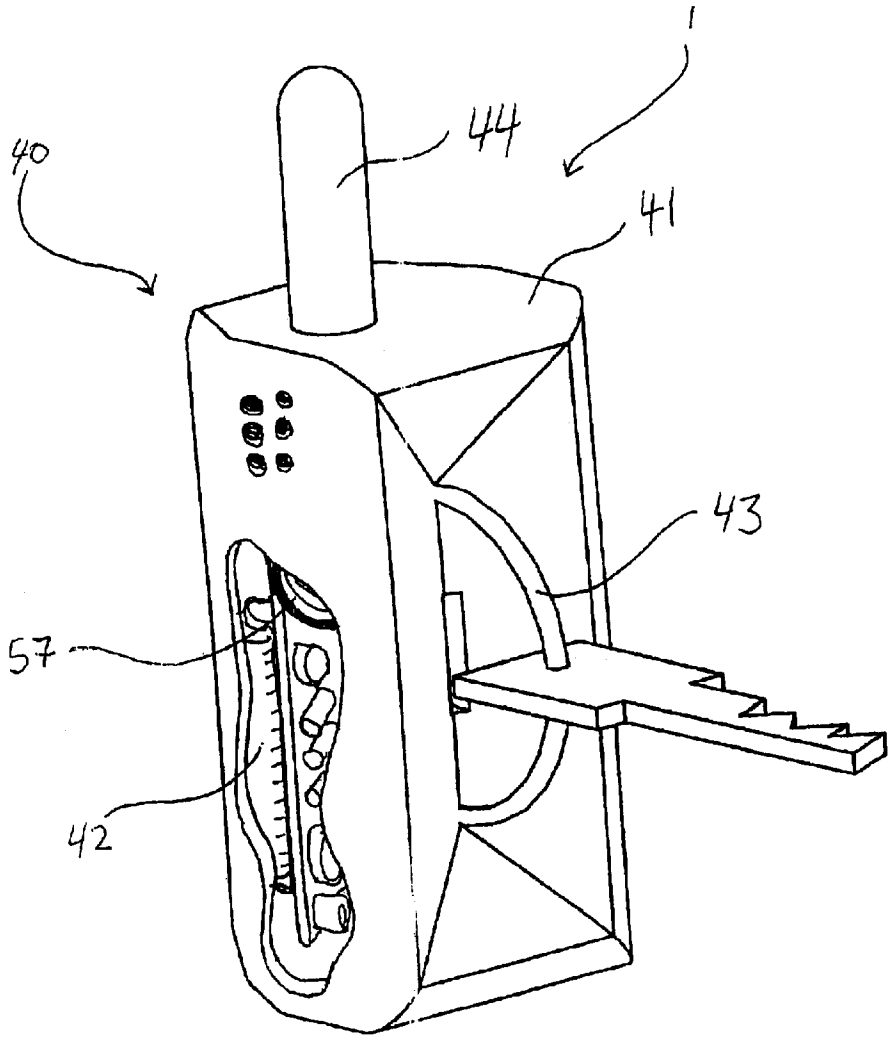
FIG. 3 depicts a partial cut-away perspective view of the response unit.

As shown in FIG. 3, the response unit 40 has a response unit body 41 that encompasses the circuitry which is connected to power source 42 also housed in the response unit body. The power source 42 can be a battery, a rechargeable battery or a direct linkup to an outside power source or to the power source of the consumer good to which the response unit 40 is attached or integrated into. For the attachment embodiment of the response unit 40, the response unit body can utilize several different attachment means 43 from hook and loop device, adhesives, clips, straps and the alike.

The response unit 40 could also be incorporated as a subcomponent of another good (cell phone) as could be the central control unit 10. In this manner, response unit 40, once integrated into the good, would afford the good all the primary location/detection aspects of the invention 1. Response unit 40 could be integrated into the goods during manufacture or during post-manufacture of the good. For example, a battery pack, removable design cover or carrying case for a cell phone could incorporate the response unit 40 to afford the location/detection benefits to a cell phone that was not originally made or designed to have such benefits. Further, the response unit could be built into a disposable power sources such as batteries or capacitors utilized by goods to confer the benefits of the invention 1 upon those goods which did not originally contain or otherwise incorporate a response unit circuitry.

Figure 4:
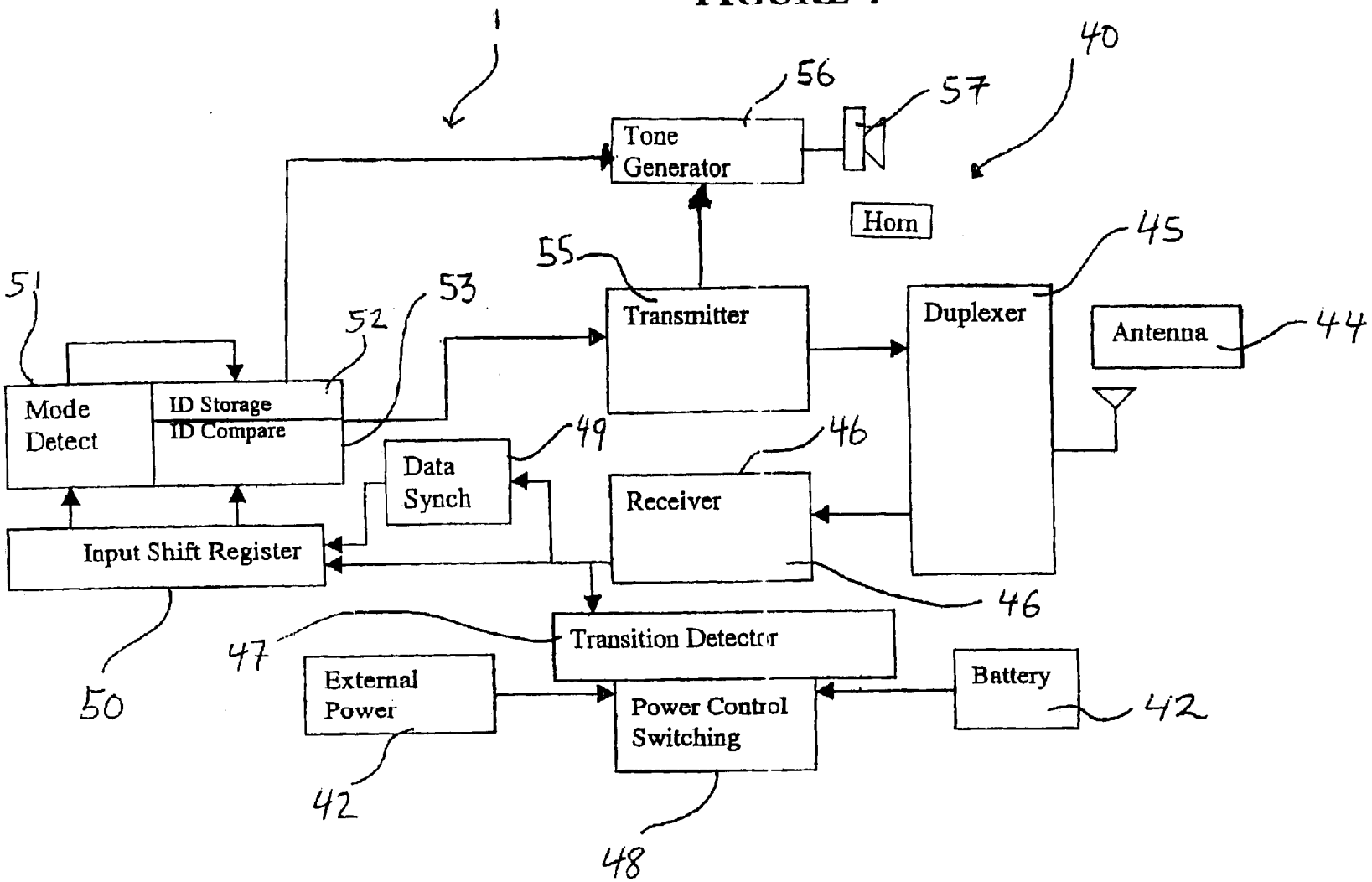
FIG. 4 depicts a block diagram of elements of the response unit.

FIG. 4 shows the block diagram of the response unit 40 which operates in two modes: program and locate. The incoming R/F SBS signal from one central control unit 10, is received by the antenna 44 of the response unit 40 and is conducted to the duplexer 45. If the received signal is within a certain preselected R/F frequency range, then the signal is passed to the receiver 46 which transforms the R/F signal into an electronic signal. The issuance of an electronic signal is sensed by a transition detector 47. The transition detector 47 activates the power control switching 48, which is connected to an external power source, such as that of the good to which the response unit 40 is attached to or otherwise incorporated into, or a battery 42. The power control switching 48 normally has the circuitry of the response unit 40 in a low power/low drain state (i.e. only the receiver and duplexer are powered to operating states). The receipt of the proper R/F signal by the response unit 40 causes the power control switching 48 to fully power up the response unit's circuitry from a low power-energy saving state.

The energy signal also activates the data synchronizer 49 whose clock issues a square wave signal into the input shift register 50. The clock of the data synchronizer 49 and that of the central control unit's output clock source 35 are synchronized as to have a corresponding square wave signal that allows the response unit to recognize the incoming signal as being from the central control unit 10. When the response unit square wave and the square wave of the incoming signal are matched in the input shift register 50, the bit data contained in the mode field of the incoming signal is sent to the mode detector 51 of the response unit 40. The mode detector 51 then sends a signal to the ID storage 52 and the ID Compare 53 to set them for either program or actuator functions. The input shift register 50 also sends the bit data from the identification field as a signal to the ID storage 52 and the ID Compare 53. If the ID storage 52 and the ID compare 53 are set for the actuator function, the ID compare 53 compares the identification field data with identification data stored in the ID storage 52. If there is a match, a signal is sent to the transmitter 55 which sends a R/F signal out through the duplexer and antenna to the remote central control unit 10 which sent the received SBS signal in the first place. The transmitter 55 also sends a signal to the tone generator 56 which activates the horn 57. The horn gives off an audible signal to guide the operator to find the response unit 40 associated with the lost object. If there is no match, no R/F signal, audible signal is emitted from the response unit 40 and the response unit returns to a powered down state.

The central control unit 10, upon receipt of R/F signal from the response unit 40, as described above, produces an audible, visual or both signal that is understandable by the operator to indicate the proximate distance between the central control unit 10 and response unit 40. After a predetermined time period, the transmitter will cease transmitting and the response unit 40 will return to its low power state.

If the ID storage 52 and the ID compare 53 are set for the program function, the ID storage 52 will accept the identification bit data from the incoming SBS signal and store them either for the first time in programming of the response unit or will reprogram the response unit 40 by displacing earlier stored identification bit information with new identification bit information from the received SBS signal. The ID storage 52 unit will then send an electrical signal to the tone generator 56 which activates the horn 57. The horn 57 gives off an audible signal to inform the operator that the response unit 40 has been programmed or reprogrammed by accepting the identification code.

Figure 5:
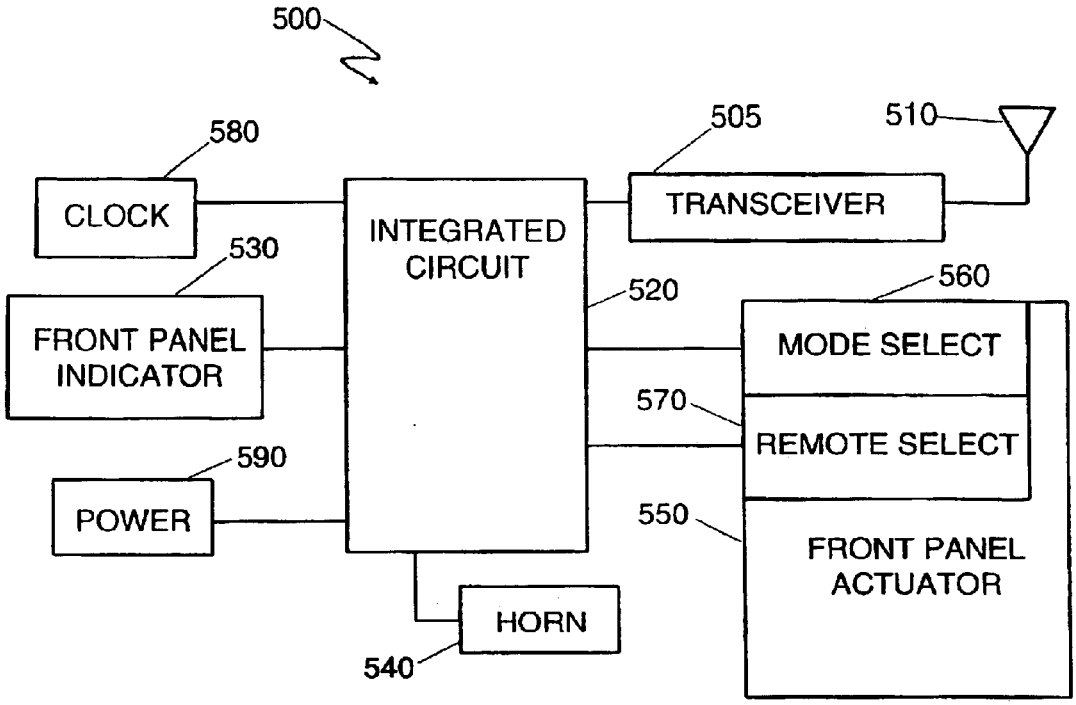
FIG. 5 illustrates a block diagram of one embodiment of the control unit.

FIG. 5 illustrates a block diagram of one embodiment of the invention. Control unit 500 has a mode selector switch that sets control unit 500 in two modes: actuate and program. In actuate mode, control unit 500 transmits a signal and then receives a signal from a remote unit (see FIG. 6) and after interpreting the strength of the received signal provides a visual and/or audible cue to an operator indicating the relative proximity of the remote unit. In program mode, control unit 500 associates one or more remote units with a specific actuator on control unit 500.

After control unit 500 sends a signal in actuator mode, transceiver 505 receives a signal through antenna 510 from a remote unit. The signal may be in R/F, infrared, microwave, very low frequency (VLF), or any other transmission medium known to those skilled in the art of signal transmission. Transceiver 505 is configured to filter out unwanted signals, for example transceiver 505 would filter R/F signals within a determined frequency range. One skilled in the art will recognize that this applies to other signal transmission mediums and will know how to achieve a desired range.

Transceiver 505 transforms the received signal into an electrical signal. Transceiver 505 directs the electrical signal to integrated circuit 520, which determines the strength and intensity of the electrical signal. Integrated circuit 520 causes light sources (not shown), for example LEDs or incandescent bulbs, in front panel indicator 530 to represent the strength of the received signal. For example, a received signal that integrated circuit 520 interprets as strong may appear as a bright light, or a rapid strobe, or several lights at once, and so forth, on front panel indicator 530. Conversely, a weak signal may appear as a dim light, a slow strobe, or only one out of many light sources. The strength of the received signal indicates the relative proximity of a remote unit. One skilled in the art will recognize that any combination of the above examples may be employed, as well as other visual cues.

Integrated circuit 520 may also cause horn 540 to emit sound corresponding to the strength of the received signal. For a strong signal horn 540 may emit a loud sound or rapidly repeated sounds. Conversely, for a weak signal horn 540 may emit a quiet sound or slowly repeated sounds.

Control unit 500 has a mode selector switch (shown in FIG. 1) that sets control unit 500 to either actuating or programming a response unit. Front panel actuator 550 houses mode select 560, which in one embodiment is mode select switch 12 of FIG. 1. Mode select 560 couples to integrated circuit 520 and indicates operation in either programming or activator modes.

While mode select 560 is in programming mode, remote select 570, which in one embodiment corresponds to actuators 11 of FIG. 1, links a specific actuator with one or more specific remote units. The one or more remote units are kept in close proximity to control unit 500. The specific actuator to be linked with the one or more remote units is activated and remote select 570 transmits to integrated circuit 520 the identity of the actuator. Integrated circuit 520 relates the identity of the actuator to a range within control unit 500's transmission medium, for example a frequency range within the R/F spectrum. Integrated circuit 520 instructs transceiver 505 to transit a low level signal from antenna 510 such that only remote units in close proximity to control unit 500 will receive the transmitted signal. The transmitted signal may contain similar information and operate in a similar manner to the SBS signal described above.

In one embodiment, control unit 500 transmits a weak signal that all remote units in close proximity will interpret as a 'program mode' signal, which prepares each remote unit in close proximity for programming. A following signal carries information identifying the actuator being associated with the one or more units. The identifying information is then stored in the remote unit.

In another embodiment, control unit 500 prepares each remote unit for programming and indicates a transmission range for the remote unit. For example, one remote unit could be programmed to respond to a signal at 200 MHz while another responds to a signal at 250 MHz. In turn, each actuator could trigger transmission in a slightly different range.

Integrated circuit 520 may use clock 580 to generate and/or synchronize signals and power source 590 may be any suitable energy source for control unit 500. One skilled in the art will recognize that many methods of associating actuators with remote units are available and the above are only examples.

Figure 6:
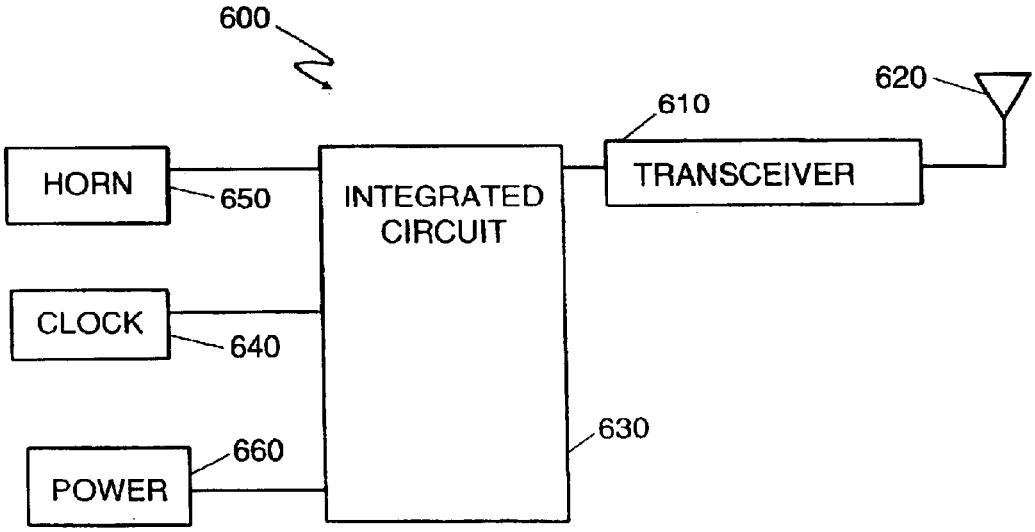
FIG. 6 illustrates a block diagram of one embodiment of the remote unit.

FIG. 6 illustrates a block diagram of one embodiment of the invention. Remote unit 600 operates in two modes: program and locate. In locate mode, transceiver 610 receives a signal (a locate signal) through antenna 620. Transceiver 610 transforms the received signal into an electrical signal and transfers it to integrated circuit 630.

Clock 640 may be used by integrated circuit 630 to synchronize the received signal. In one embodiment, the received signal has the SBS format outlined above. Clock 640 allows remote unit 600 to recognize and synchronize the received signal. Integrated circuit 630 determines what mode the received signal indicates and then places remote unit 600 in that mode. Integrated circuit 630 then determines if the identification in its memory (not shown) matches the identification in the received signal. If the signal indicates locate and there is an identification match, integrated circuit 630 instructs transceiver 610 to transmit a signal to the control unit, which will then determine the strength of the signal from remote unit 600 and act according to the above description. In one embodiment integrated circuit 630 sends a signal to horn 650, causing an audible alarm. If there is no identification match then remote unit 600 does nothing.

In another embodiment integrated circuit 630 has more than one identification in its memory.

If the SBS signal indicates program mode (with a program signal) then integrated circuit 520 takes ID information from the SBS signal and stores it in memory (not shown).

In another embodiment, remote unit 600 is programmed to respond to a certain range within the transmission medium, for example to a certain range in R/F.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A locating system comprising:

a control unit configured with a program mode and a locate mode, the control unit comprising:

a first integrated circuit;

a transceiver coupled to the first integrated circuit; and a first actuator coupled to the integrated circuit and configured such that when the control unit is in program mode and the first actuator is activated, the control unit transmits a first signal indicating that the control unit is in program mode and identifying the first actuator.

2. The control unit of claim 1 wherein the identification of the first actuator is a serial bit stream identification.

3. The control unit of claim 1 wherein the identification of the first actuator is a range in a transmission medium.

4. The system of claim 1 further comprising:

a first remote unit configured to have a program mode and a locate mode, wherein the first remote unit upon receiving the first signal enters program mode and stores the identity of the first actuator.

5. The control unit of claim 1 further comprising:

a second actuator coupled to the first integrated circuit and configured such that when the control unit is in program mode and the second actuator is activated, the control unit transmits a second signal indicating that the control unit is in program mode and identifying the second actuator, and the identification for the second actuator differing from the identification for the first actuator.

6. The control unit of claim 5 wherein the control unit is configured such that when in locate mode and responding to activation of the first actuator, the control unit transmits a third signal indicating that the control unit is in locate mode and identifying the first actuator.

7. The control unit of claim 6 wherein the control unit is configured such that when in locate mode and responding to activation of the second actuator, the control unit transmits a fourth signal indicating that the control unit is in locate mode and identifying the second actuator.

8. The control unit of claim 7 further comprising:

a front panel indicator coupled to the first integrated circuit, wherein the control unit is configured to receive a fifth signal in response to the third signal and display upon the front panel indicator the relative distance of the source of the fifth signal based on the strength of the fifth signal.

9. The control unit of claim 8 wherein the control unit is configured to receive a sixth signal in response to the fourth signal and display upon the front panel indicator the relative distance of the source of the sixth signal based on the strength of the sixth signal, the sixth signal having a different source than the fifth signal.

10. The system of claim 5 further comprising:

a first remote unit configured to have a program mode and a locate mode, wherein the first remote unit upon receiving the first signal enters program mode and stores the identity of the first actuator; and a second remote unit configured to have a program mode and a locate mode, wherein the second remote unit upon receiving the second signal enters program mode and stores the identity of the second actuator.

11. The system of claim 10 wherein, during transmission of the first signal, the first remote unit is in close proximity to the control unit and the second remote unit is not in close proximity to the control unit, and during transmission of the second signal, the first remote unit is not in close proximity to the control unit and the second remote unit is in close proximity to the control unit.

12. A remote unit comprising:

a transceiver; and an integrated circuit coupled to the transceiver, wherein the remote unit is configured to receive a first signal from a control unit locating device, the first signal indicating a program mode and identifying a first actuator, the integrated circuit storing the identity of the first actuator.

13. The remote unit of claim 12 wherein the remote unit is configured to receive a second signal from the control unit locating device, the second signal indicating a program mode and identifying a second actuator, the integrated circuit storing the identity of the second actuator.

14. The remote unit of claim 13 wherein the stored identity of the second actuator replaces the stored identity of the first actuator.

15. The remote unit of claim 13 wherein the integrated circuit stores the identity of the second actuator in addition to the stored identity of the first actuator.

16. The remote unit of claim 12 wherein the remote unit is configured to receive a second signal from the control unit locating device, the second signal indicating a locate mode and identifying a first actuator, the remote unit responding by transmitting a third signal if the identity of the first actuator was received by the remote unit during a program mode and the identity of the first actuator is stored in the remote unit.

17. The remote unit of claim 16 wherein the third signal is an audible signal.

18. The remote unit of claim 12 further comprising a serial bit stream identification in the identification of the first actuator.

19. The remote unit of claim 12 further comprising a range in the transmission medium in the identification of the first actuator.

20. The remote unit of claim 12 further configured to emit an audible signal upon storage of the identity of the first actuator.

21. A locating system comprising:

a control unit configured with a program mode and a locate mode, the control unit comprising:

a transceiver;

a first actuator coupled to the transceiver; and a means for transmitting a signal in the program mode, the signal containing an identity for the actuator and intended to identify the actuator for use in the locate mode.

22. A remote unit comprising:

a transceiver;

a means for receiving a program signal from a control unit locating device, the program signal containing an identity for an actuator; and a means for storing the identity of the actuator for comparison with a locate signal.

* * * * *